US012397959B2

(12) United States Patent
Berroa García

(10) Patent No.: US 12,397,959 B2
(45) Date of Patent: Aug. 26, 2025

(54) NECK FOR GLANDS OF LIQUID CONTAINERS

(71) Applicant: BETAPACK, S.A.U., Irun (ES)

(72) Inventor: Javier Berroa García, Irun (ES)

(73) Assignee: BETAPACK, S.A.U., Irun (ES)

( * ) Notice: Subject to any disclaimer, the term of this patent is extended or adjusted under 35 U.S.C. 154(b) by 31 days.

(21) Appl. No.: 18/372,765

(22) Filed: Sep. 26, 2023

(65) Prior Publication Data

US 2024/0101298 A1 Mar. 28, 2024

(30) Foreign Application Priority Data

Sep. 26, 2022 (ES) ..... 202231565

(51) Int. Cl.
*B65D 1/02* (2006.01)

(52) U.S. Cl.
CPC ..... *B65D 1/0246* (2013.01); *B65D 1/0207* (2013.01)

(58) Field of Classification Search
CPC .... B65D 1/0246; B65D 1/023; B65D 1/0207; B65D 1/46; B65D 11/22; B65D 11/26
USPC ..... 215/42, 40, 43; 220/649, 648, 646, 657, 220/658, 656
See application file for complete search history.

(56) References Cited

U.S. PATENT DOCUMENTS

| | | | | | |
|---|---|---|---|---|---|
| 18,220 | A * | 9/1857 | Atterbury | F28D 1/06 | 215/400 |
| 4,715,504 | A * | 12/1987 | Chang | B29C 45/1684 | 264/513 |
| 8,544,663 | B2 * | 10/2013 | Barel | B29C 49/071 | 220/656 |
| 2015/0375887 | A1 * | 12/2015 | Van Dijck | B65D 1/0207 | 428/35.8 |
| 2023/0303287 | A1 * | 9/2023 | Jarman | B29C 49/071 | |
| 2024/0166401 | A1 * | 5/2024 | Mejia-Quinchia | B65D 41/08 | |

FOREIGN PATENT DOCUMENTS

| | | | | |
|---|---|---|---|---|
| CA | 2956727 | C * | 9/2023 | B65D 1/02 |
| EP | 2933201 | A1 | 10/2015 | |
| EP | 3608248 | A1 | 2/2020 | |

* cited by examiner

*Primary Examiner* — Robert J Hicks
(74) *Attorney, Agent, or Firm* — MARSHALL, GERSTEIN & BORUN LLP

(57) ABSTRACT

A container for liquids, specifically a neck designed to be axially coupled to the gland of a container, typically made of lightweight plastic. The neck is structured in a lower section and an upper section, having several components: a lower collar that serves as a support, followed by a support flange and a cylindrical part that incorporates both lower and upper transitions, as well as an intermediate section. The terminal part of the neck is an upper washer designed to receive a sealing plug. This washer includes a lower ring, a straight portion and an upper ring. The complete design ensures an effective threaded engagement with the sealing plug, thus optimizing the functionality of the container.

7 Claims, 3 Drawing Sheets

NECK FOR GLANDS OF LIQUID CONTAINERS

OBJECT OF THE INVENTION

The present invention falls within the technical field of liquid containers, and relates in particular to a neck that can be attached to the gland of a liquid container. It is especially designed for lightweight plastic containers, and comprises elements that allow for the threaded attachment of a top closure cap.

BACKGROUND TO THE INVENTION

In the present state of the art, various liquid containers are known that are specially designed to allow the direct consumption of the product contained through the pouring hole, without the need to pour it into a container. Among these containers are known those specially configured to contain semi-liquid fluids of high density such as liquid yoghurts or milkshakes.

An example of such containers can be found in the European patent with publication number EP3608248, which relates to a container for food or foodstuffs or containers in the form of cups or jars, where the foodstuffs contained therein may be i) liquids, for example a beverage or milk or milk products, ii) semi-liquids, for example yoghurt or cream or fruit smoothies, iii) solids, in the form of chips, granules or powder, for example fruit, cereals or chocolate. The food or foodstuffs may be loose or already packed in jars.

On the other hand, it is desirable that such containers should be as lightweight as possible without compromising stability.

European patent publication number EP2933201 describes a plastic container including a hollow body portion including a bottom support base portion; a sidewall portion extending upwardly from the base portion; and a neck portion extending upwardly from the sidewall portion. The neck portion includes a support flange having a top and bottom surface, a tamper evidence formation, and a distribution opening at the top of the neck portion. In one embodiment, the distribution opening has an inside diameter of at least 22 mm, and the vertical distance from the top of the distribution opening to the bottom surface of the support flange is 0.580 inches or less.

A neck that can be attached to the neck of an existing lightweight container helps to increase the stability of the container with little negative impact on the overall weight.

SUMMARY OF THE INVENTION

The subject matter of the invention consists of a neck for glands of liquid containers where the gland is terminated by a pouring orifice allowing the liquid to exit from the interior of the container. The neck comprises elements for retaining the neck in the gland and elements for coupling a plug for opening and closing the pouring hole.

The neck is formed from a tubular body made of a lightweight plastic material, similar to that of the container into which it is intended to be axially coupled, such as polyethylene terephthalate (PET) or high density polyethylene (HDPE).

The tubular body comprises the following consecutive parts, described from a lower section to an upper section: a lower support collar, a support flange, a cylindrical part and an upper washer.

The lower collar is intended to be mated and in intimate contact with the gland. The support flange is configured to facilitate manual gripping of the container through the neck. In this preferred embodiment of the neck, the support flange consists of a serrated annular body with ridges and valleys.

The cylindrical part acts as a transition between the support flange and the upper washer, and represents the part of the neck with the smallest diametrical dimensions. Finally, the upper washer is intended to receive the sealing plug.

BRIEF DESCRIPTION OF THE DRAWINGS

In order to complement the description being made and in order to assist in a better understanding of the features of the invention, in accordance with a preferred example of a practical embodiment thereof, a set of drawings is attached hereto as an integral part of the said description, in which the following is illustratively and non-limitingly depicted.

DETAILED DESCRIPTION OF THE DRAWINGS

A detailed explanation of an example of a preferred embodiment of the subject matter of the present invention is given below with the aid of the figures referred to above.

Figure 1:
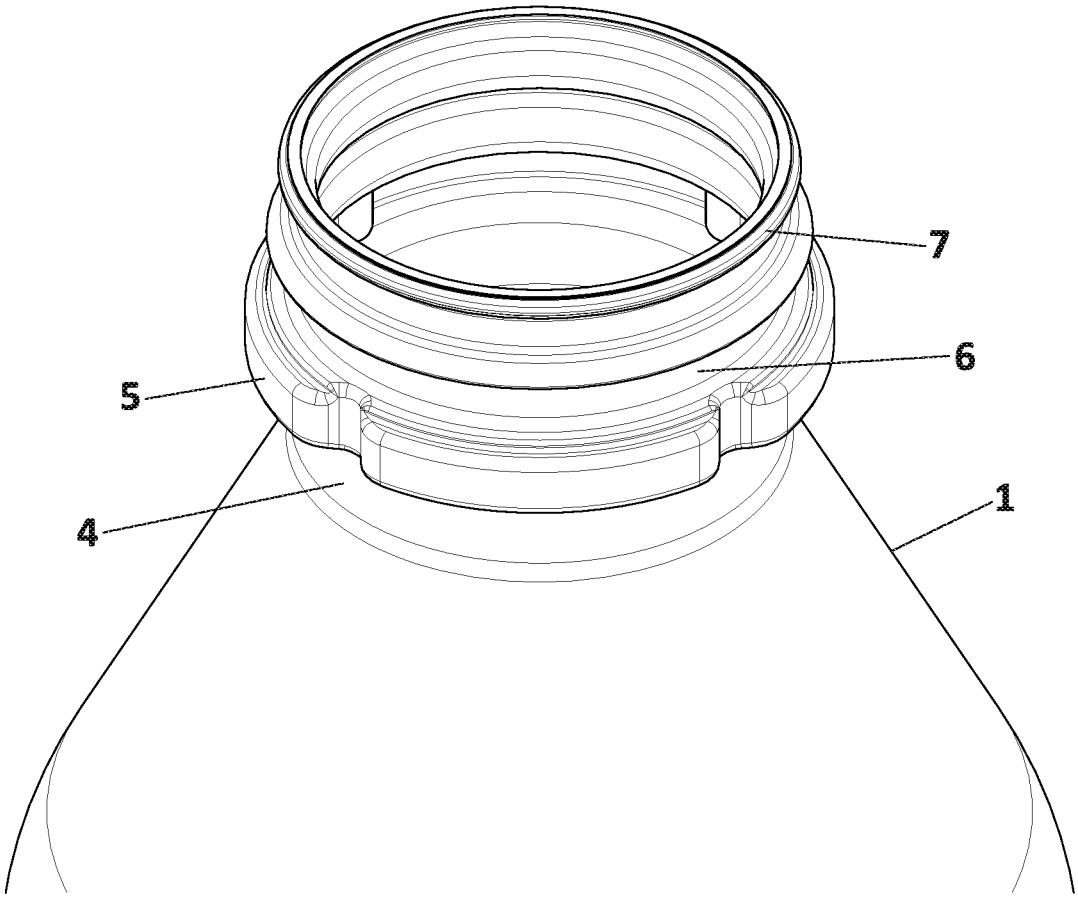
FIG. 1 shows a first perspective view of the neck inserted in the gland of a container.
Figure 2:
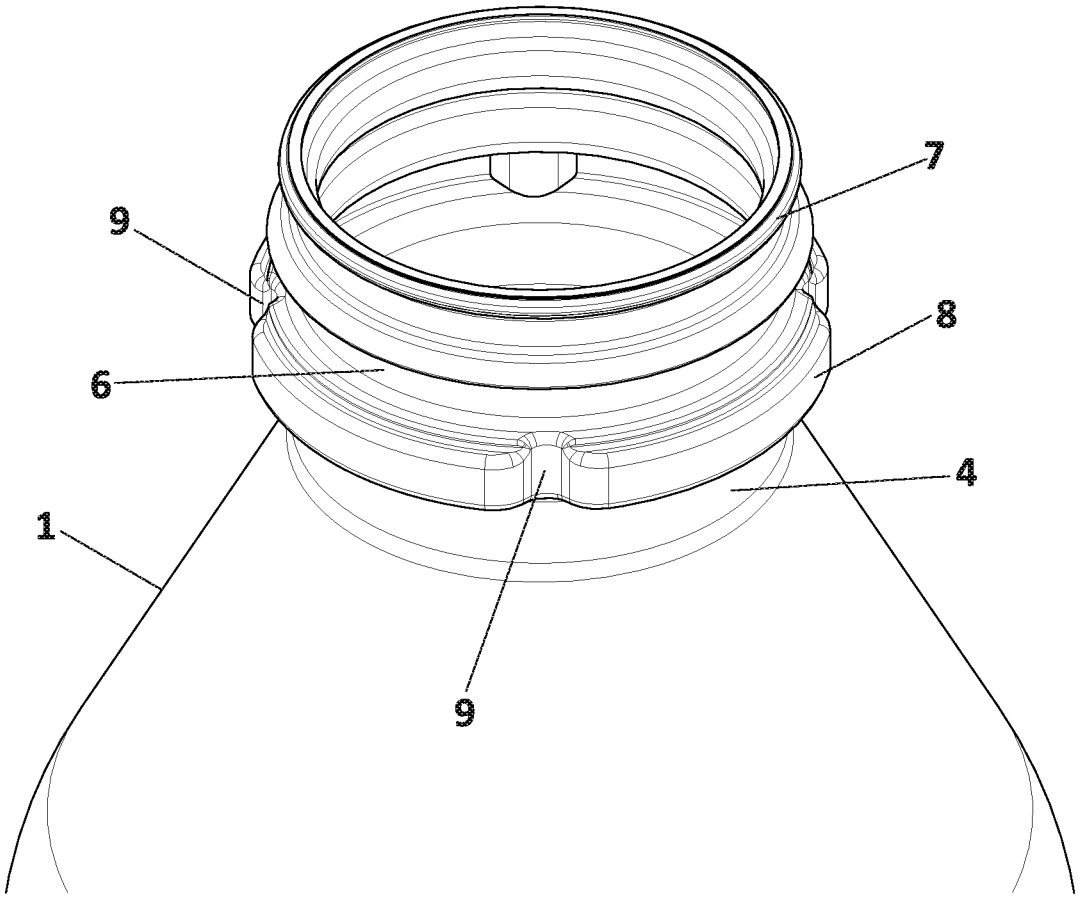
FIG. 2 shows a second perspective view of the neck inserted into the gland of a container.
Figure 3:
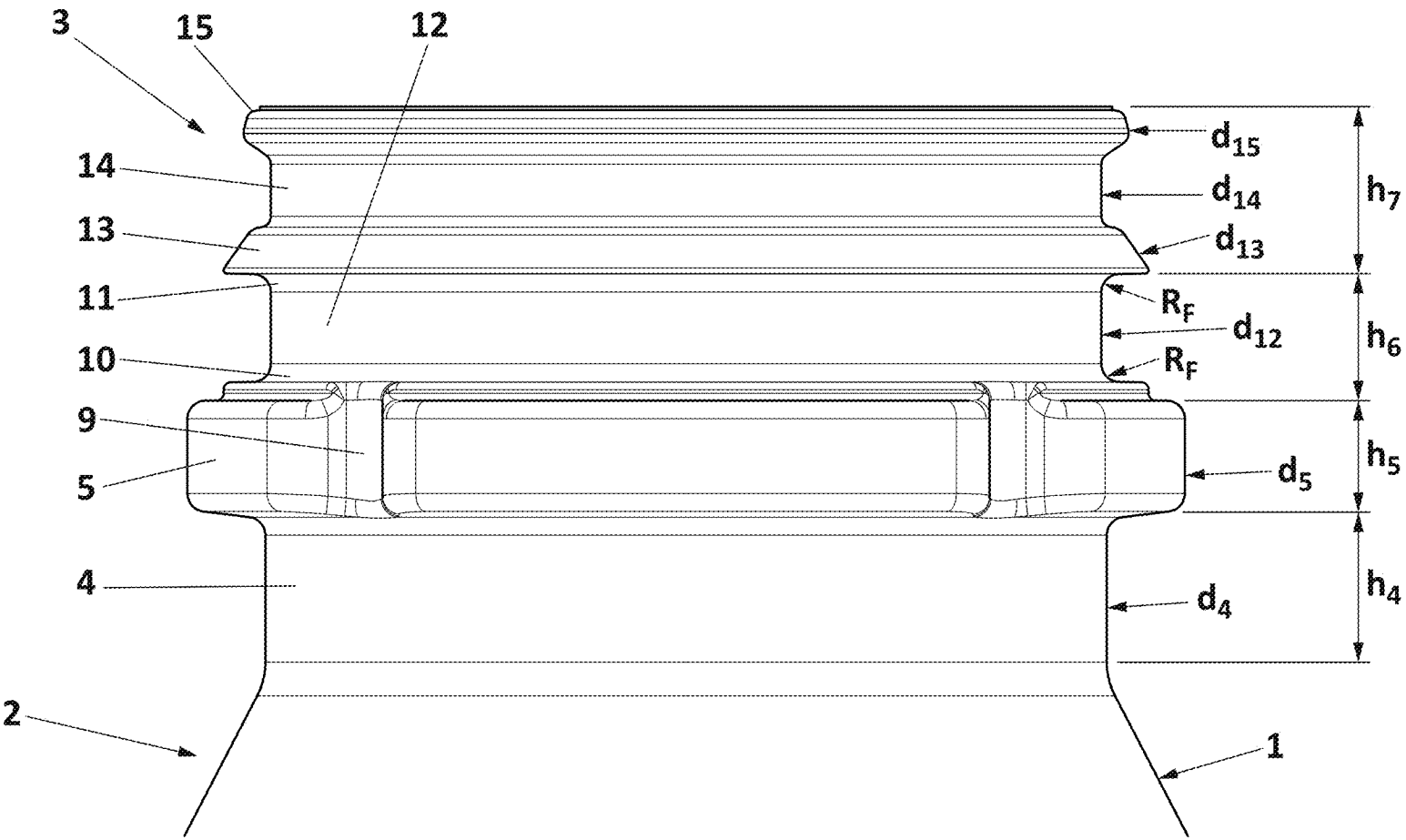
FIG. 3 shows a front view of the neck inserted in the gland of a container, where the dimensions and diameters are indicated.

The neck for glands of liquid containers shown in FIGS. 1 and 2 is formed from a tubular body which can be axially coupled to the gland (1) of a container and which is intended to receive, at its upper end, a closing plug not shown in the attached figures. The stopper allows the opening and closing of a liquid pouring orifice delimited by the gland (1), and therefore by the neck once it is attached to the gland (1).

The tubular body has a lower section (2) and an upper section (3). The lower section (2) is intended to be in intimate contact with an initial part of the gland (1), while the upper section is intended to be aligned with the pouring hole at the upper end of the gland (1).

The tubular body comprises the following consecutive parts, described from the lower section (2) towards the upper section (3): a lower support collar (4), a support flange (5), a cylindrical part (6) and an upper washer (7).

The lower collar (4) is intended to be mated and in intimate contact with the gland (1). It has a height (h4) measured between the lower end of the lower section (2) and the lower end of the support flange (5). The height (h4) has a value, in millimeters, in the range from 4.3 mm to 4.7 mm, including the upper and lower extreme values of that range, and an internal diameter (d4) in the range from 23 mm to 23.4 mm, including the upper and lower extreme values of that range.

The support flange (5) is intended to facilitate manual gripping of the container through the neck. As can be seen in the attached figures, in this preferred embodiment, the support flange (5) consists of a serrated annular body, with ridges (8) and valleys (9) equidistant along the entire length of the annular body. It has a height (h5) measured between the lower collar (4) and the cylindrical part (6). The height (h5) has a value, in millimeters, in the range from 2.8 mm to 3.2 mm, including the upper and lower extreme values of that range, and an internal diameter (d5) in the range from 28.1 mm to 28.7 mm, including the upper and lower extreme values of that range.

The cylindrical part (6) comprises a lower transition (10), an upper transition (11) and an intermediate section (12). The lower transition (10) has a radius of fusion (Rf) with the uppermost end of the support flange (5), and the upper transition (11) has a similar radius of fusion (Rf) with the upper washer (7). The cylindrical part (6) has a total height (h6) measured between the support flange (5) and the upper washer (7). The height (h6) has a value in the range from 3.7 mm to 4.1 mm, including the upper and lower extreme values of this range.

The intermediate section (12) has an internal diameter (d12) in the range from 23.1 mm to 23.5 mm, including the upper and lower extreme values of this range.

The upper washer (7) is intended to receive the sealing plug, and comprises in turn, consecutively, a lower ring (13), a straight portion (14) and an upper ring (15). The upper washer (7) has a total height (h7) measured between the cylindrical part (6) and the uppermost end of the upper section (3). The height (h7) has a value in the range from 3.9 mm to 4.3 mm, including the upper and lower extreme values of this range.

The lower ring (13) has an internal diameter (d13) in the range from 25.1 mm to 25.5 mm, including the upper and lower extreme values of this range. The straight portion (14) has an internal diameter (d14) ranging from 23.1 to 23.5 mm. The upper ring (15) has an internal diameter (d15) in the range from 24 mm to 24.4 mm.

The above descriptions of specific embodiments of the present invention have been presented for purposes of illustration and description. They are not intended to be exhaustive or to limit the invention to the precise forms disclosed, and various modifications and variations are possible in the light of the above teachings. The embodiments were chosen and described in order to explain the principles of the invention and its practical application, thus to enable others skilled in the art to use the invention and various embodiments with various modifications that are suitable for the particular use contemplated. It is intended that the scope of the invention be defined by the appended claims.

The invention claimed is:

1. A neck for glands of liquid containers, formed from a tubular body axially attachable to the gland of a container, the tubular body having a lower section and an upper section, the neck being characterized in that the tubular body comprises the following consecutive parts, described from the lower section towards the upper section:

- a lower collar with a height in the range of 4.3 mm to 4.7 mm and an internal diameter in the range of 23 mm to 23.4 mm;
- a support flange with a height in the range of 2.8 mm to 3.2 mm and an internal diameter in the range of 28.1 mm to 28.7 mm;
- a cylindrical part with a height in the range of 3.7 mm to 4.1 mm, further comprising:
  - a lower transition, having a radius of fusion with the uppermost end of the support flange;
  - an upper transition with a radius of fusion; and
  - an intermediate section with an internal diameter in the range of 23.1 mm to 23.5 mm; and
- an upper washer, designed to receive a sealing plug, having a height in the range from 3.9 mm to 4.3 mm, comprising in turn:
  - a lower ring, with an inner diameter ranging from 25.1 mm to 25.5 mm;
  - a straight portion, having an internal diameter in the range of 23.1 to 23.5 mm; and
  - an upper ring with an inner diameter ranging from 24 mm to 24.4 mm.

2. The neck for glands according to claim 1, wherein the support flange consists of a serrated annular body with ridges and valleys.

3. The neck for glands according to claim 1, wherein the tubular body is made of polyethylene terephthalate (PET) or high density polyethylene (HDPE).

4. The neck for glands according to claim 2, wherein the tubular body is made of polyethylene terephthalate (PET) or high density polyethylene (HDPE).

5. The neck for glands according to claim 1, wherein the support flange comprises a serrated annular body with ridges and valleys.

6. The neck for glands according to claim 5, wherein the tubular body is made of polyethylene terephthalate (PET) or high density polyethylene (HDPE).

7. The neck for glands according to claim 1, wherein the radius of fusion of the upper transition is with the upper washer.

* * * * *